US006817208B2

(12) United States Patent
Choi et al.

(10) Patent No.: US 6,817,208 B2
(45) Date of Patent: Nov. 16, 2004

(54) AUXILIARY STORAGE SYSTEM FOR REFRIGERATOR

(75) Inventors: Young-Seok Choi, Busan Metropolitan (KR); Byeong-Gyu Kang, Gimhae (KR); Sang-Bae Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/470,336

(22) PCT Filed: Feb. 8, 2002

(86) PCT No.: PCT/KR02/00211

§ 371 (c)(1),
(2), (4) Date: Jul. 28, 2003

(87) PCT Pub. No.: WO02/065035

PCT Pub. Date: Aug. 22, 2002

(65) Prior Publication Data

US 2004/0050078 A1 Mar. 18, 2004

(30) Foreign Application Priority Data

Feb. 15, 2001 (KR) ..... 10-2001-07592
Aug. 31, 2001 (KR) ..... 10-2001-53398

(51) Int. Cl.[7] ..... F25D 17/04
(52) U.S. Cl. ..... 62/408; 62/407; 62/447
(58) Field of Search ..... 62/407, 408, 411, 62/412, 441, 443, 447, 453

(56) References Cited

U.S. PATENT DOCUMENTS 4,586,347 A 5/1986 McCarty ..... 62/265
5,437,503 A 8/1995 Baker et al. ..... 312/404
6,223,553 B1 5/2001 Albert et al. ..... 62/407
6,463,752 B2 * 10/2002 Mandel et al. ..... 62/382
2002/0116943 A1 * 8/2002 Tupis et al. ..... 62/407
2003/0037564 A1 * 2/2003 Tupis et al. ..... 62/407

FOREIGN PATENT DOCUMENTS

JP 52-120454 10/1977
KR 1002860370000 1/2001

* cited by examiner

*Primary Examiner*—Melvin Jones
(74) *Attorney, Agent, or Firm*—Fleshner & Kim, LLP

(57) ABSTRACT

The present invention relates to an auxiliary storage system for a refrigerator. The auxiliary storage system of the present invention comprises an insulating body which includes a forwardly opened predetermined space therein, is installed within a storage space of the refrigerator, and are formed of insulating material to prevent heat exchange with the storage space; a blower fan unit for supplying cold air into the insulating body; a heat transfer tray installed within the space of the insulating body for defining a cold air flow passage between the insulating body and the heat transfer tray and performing heat exchange between an internal space thereof and the cold air flowing through the flow passage; a drawer type auxiliary storage compartment which can be pushed into and pulled out from the heat transfer tray through a front face of the insulating body; a shelf for shielding a top side of the insulating body so as to define a space for accommodating the auxiliary storage compartment in cooperation with the insulating body; a sensing device installed within the auxiliary storage compartment for sensing a temperature therein, and a temperature control device for controlling the temperature in the auxiliary storage compartment by controlling the blower fan unit while comparing information on the temperature sensed by the sensing device with a temperature set by a user. According to the present invention, accommodated goods can be stored longer and fresher since the auxiliary storage compartment in not influenced by the temperature in the storage space in which the auxiliary storage compartment is installed.

7 Claims, 7 Drawing Sheets

AUXILIARY STORAGE SYSTEM FOR REFRIGERATOR

TECHNICAL FIELD

The present invention relates to a refrigerator, and more particularly, to an auxiliary storage system which is installed in a storage space and of which temperature can be controlled separately from the storage space.

BACKGROUND ART

In general, a side-by-side refrigerator has a relatively large storage capacity and provides various and multiplex functions. Further, the refrigerator includes refrigerating and freezing chambers that are installed side by side with respect to each other.

A storage compartment of which temperature can be individually controlled is additionally installed within the refrigerating or freezing chamber of the refrigerator so that specific stored goods therein can be stored for a long time. To this end, the temperature in the storage compartment is set to be different from that of the refrigerating or freezing chamber.

A refrigerator in which such a storage compartment is installed is disclosed in U.S. Pat. No. 6,170,276. However, the refrigerator disclosed in the '276 patent has the following problems.

That is, there is a problem in that the goods stored in the storage compartment are influenced by the temperature of the refrigerating or freezing chamber in which the storage compartment is installed, since thermal insulation between the storage compartment and the exterior thereof is not sufficiently performed.

Further, in order to maintain freshness of the goods stored in the storage compartment, the stored goods are subjected to indirect cooling. According to the refrigerator disclosed in the above patent, a cold air supply port for supplying cold air from the freezing chamber to the vicinity of the storage compartment and a cold air discharge port for discharging the cold air from the vicinity of the storage compartment to the freezing chamber are formed to be adjacent to each other. Therefore, there is another problem in that the cold air cannot be transferred uniformly throughout the storage compartment.

In addition, there is a further problem in that the refrigerating chamber may be excessively cooled if the cold air, which is supplied from the freezing chamber to the vicinity of the storage compartment installed within the refrigerating chamber so as to maintain the temperature in the storage compartment, leaks out to the refrigerating chamber.

DISCLOSURE OF INVENTION

Therefore, the present invention is conceived to solve the aforementioned problems of the prior art. An object of the present invention is to provide an auxiliary storage system wherein a temperature in an auxiliary storage compartment formed additionally within a storage space of a refrigerator is not completely influenced by a temperature in the storage space of the refrigerator.

Another object of the present invention is to provide an auxiliary storage system wherein the temperature in the auxiliary storage compartment can be uniformly maintained throughout the storage compartment.

A further object of the present invention is to provide an auxiliary storage system wherein cold air supplied to the auxiliary storage compartment cannot leak out to the interior of the storage space with the auxiliary storage compartment installed therein.

According to an aspect of the present invention for achieving the above objects, there is provide an auxiliary storage system which comprises an insulating body which includes a forwardly opened predetermined space therein, is installed within a storage space of the refrigerator, and are formed of insulating material to prevent heat exchange with the storage space; a blower fan unit for supplying cold air into the insulating body; a heat transfer tray installed within the space of the insulating body for defining a cold air flow passage between the insulating body and the heat transfer tray and performing heat exchange between an internal space thereof and the cold air flowing through the flow passage; a drawer type auxiliary storage compartment which can be pushed into and pulled out from the heat transfer tray through a front face of the insulating body; a shelf for shielding a top side of the insulating body so as to define a space for accommodating the auxiliary storage compartment in cooperation with the insulating body; a sensing device installed within the auxiliary storage compartment for sensing a temperature therein; and a temperature control device for controlling the temperature in the auxiliary storage compartment by controlling the blower fan unit while comparing information on the temperature sensed by the sensing device with a temperature set by a user.

It is preferred that the insulating body be installed at one side of a refrigerating chamber formed adjacent to a freezing chamber, and that the cold air in the freezing chamber be supplied into the insulating body through any one of rear and front sides of the insulating body and is discharged from the insulating chamber through the other side thereof.

It is also preferred that a cell cover for maintaining humidity in the auxiliary storage compartment is further provided between a bottom surface of the shelf and a top side of the insulating body.

Further, it is preferred that the blower fan unit be installed at a rear portion within the insulating body and the heat transfer tray be made of aluminum.

Fixing rings, which are made of elastic materials and installed around protruding portions of a cold air supply port and a cold air discharge port of a barrier toward the insulating body, may be seated into a cold air inlet and a cold air outlet of the insulating body, respectively, and a corner of the insulating body opposite to the cold air inlet and outlet may be supported by an elastic support which is seated onto a corner of the storage space, whereby the insulating body is fixed into the storage space.

Furthermore, it is preferred that the fixing rings take a hollow conical shape and each of the cold air inlet and outlet have a shape corresponding to that of the fixing ring.

BRIEF DESCRIPTION OF DRAWINGS

The above and other objects and features of the present invention will become apparent from the following description of a preferred embodiment given in conjunction with the accompanying drawings, in which.

BEST MODE OF CARRYING OUT THE INVENTION

Hereinafter, a preferred embodiment of an auxiliary storage system for a refrigerator according to the present invention will be explained in detail with reference to the accompanying drawings.

Figure 1:
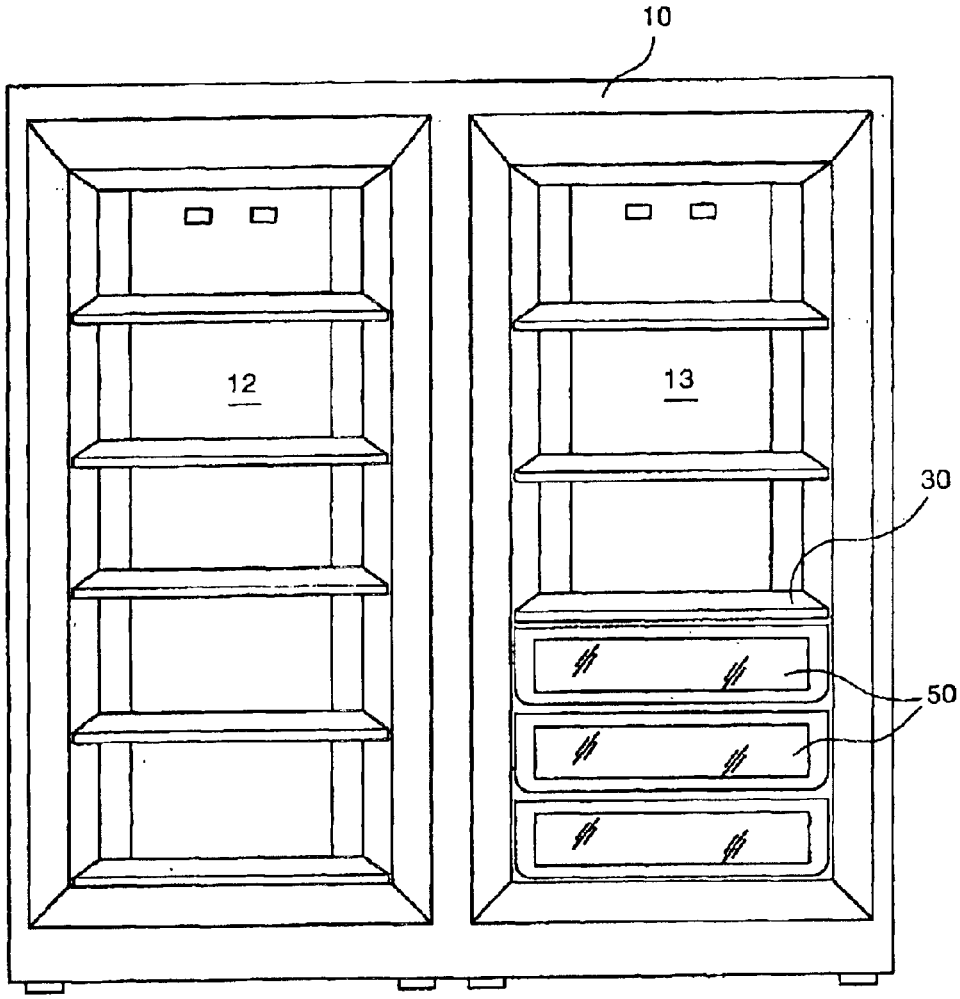
FIG. 1 is a perspective view showing the internal constitution of a side-by-side refrigerator in which an auxiliary storage system according to a preferred embodiment of the present invention is included.

Referring to FIG. 1 shown in a state where a door is removed from a refrigerator, a freezing chamber 12 and a refrigerating chamber 13, which are storage spaces, are formed side by side within a main body 10 of the refrigerator. The main body of the refrigerator is partitioned from side to side into the freezing chamber 12 and the refrigerating chamber 13 by a barrier 15 (refer to FIG. 3). Each of the freezing and refrigerating chambers 12, 13 is partitioned into a plurality of spaces for storing goods by shelves 30 and the like. A plurality of auxiliary storage compartments 50 are installed within one of the spaces located at a lower end side of the refrigerating chamber 13. Although the auxiliary storage compartments 50 are installed within the refrigerating chamber 13, they are not influenced by internal environments of the refrigerating chamber 13.

Figure 2:
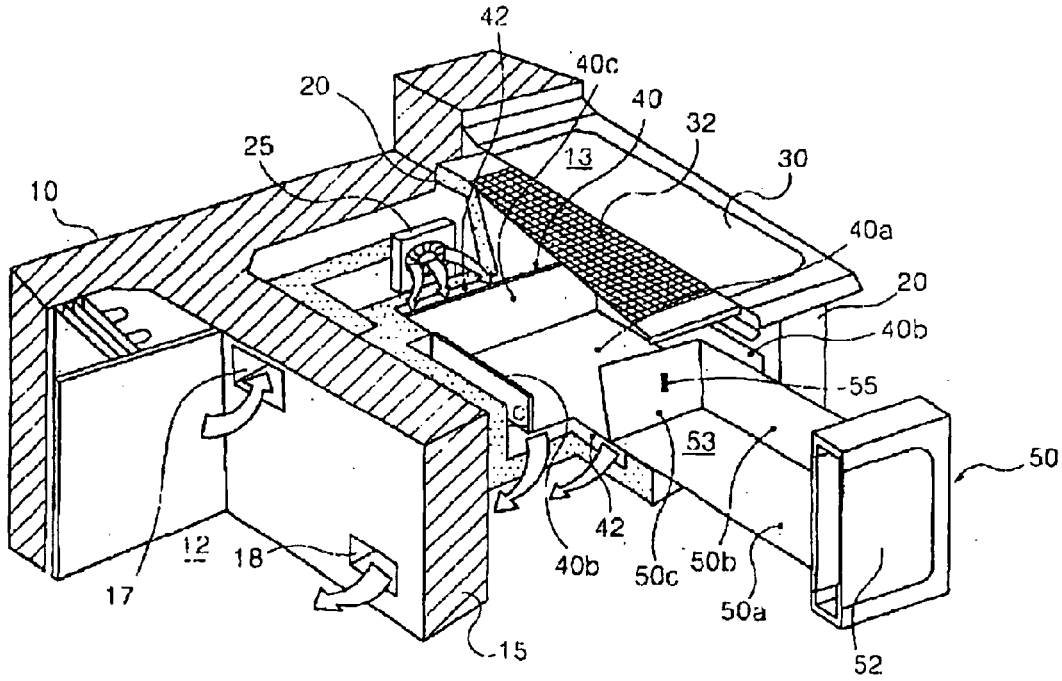
FIG. 2 is a partly cut-away perspective view showing the constitution of the auxiliary storage system according to the preferred embodiment of the present invention.

FIG. 2 shows the internal constitution of an auxiliary storage system according to the preferred embodiment of the present invention. As shown in the figure, a cold air supply port 17 and a cold air discharge port 18 are bored through the barrier 15 by which the freezing and refrigerating chambers 12, 13 are separated from each other. Cold air in the freezing chamber 12 is supplied through the cold air supply port 17 to the auxiliary storage system installed within the refrigerating chamber 13, and then, the cold air which has passed through the auxiliary storage system is discharged back through the cold air discharge port 18 into the freezing chamber 12.

An insulating body 20 is installed within the refrigerating chamber 13 and is formed of an insulation material not to be influenced by the internal environments of the refrigerating chamber 13. The insulating body 20 takes an exterior shape corresponding to an interior shape of the refrigerating chamber 13. In the preferred embodiment of the present invention, the insulating body takes a hexahedral shape with open top and front faces thereof. Of course, the insulating body 20 may be formed such that only the front face thereof is opened. The insulating body 20 includes a cold air inlet and a cold air outlet that are formed to communicate with the cold air supply port 17 and the cold air discharge port 18, respectively.

A blower fan unit 25 is further installed within the insulating body 20. The blower fan unit 25 provides driving force which allows the cold air in the freezing chamber 12 to be drawn into the insulating body 20 through the cold air supply port 17 so as to flow therein.

A top portion of the insulating body 20 is shielded by one of the shelves 30. The shelf 30 allows the top portion of the insulating body 20 to be shielded and the stored goods to be placed thereon. The shelf is made of glass material. A cell cover 32 may be installed between the shelf 30 and the top portion of the insulating body 20. The cell cover 32 can hold moisture, therein to keep the insulating body 20 at an appropriate humidity.

Furthermore, a heat transfer tray 40 is also installed within the insulating body 20. It is preferred that the heat transfer tray 40 be made of material having a high heat transfer rate or coefficient. Thus, aluminum is employed in the preferred embodiment of the present invention. Like the insulating body 20, the heat transfer tray 40 is formed to take a hexahedral shape with open top and front faces thereof.

Between an outer surface of the heat transfer tray 40 and an inner surface of the insulating body 20 is formed a cold air flow passage 42 through which the cold air introduced by the blower fan unit 25 flows. The cold air flow passage 42 is formed by making some portions of the insulating body 20 protrude from the rest of the insulating body such that the portions of the insulating body can support the outer surface of the heat transfer tray 40 thereon. For example, the protruding portions of the insulating body 20 support four lower corner portions of the heat transfer tray 40 thereon, so that the cold air flow passage 42 can be formed between the outer surface of the heat transfer tray 40 and the inner surface of the insulating body 20.

Within a forwardly opened space defined by the heat transfer tray 40 and the cell cover 32 is installed a drawer type auxiliary storage compartment 50 which can be pushed into and pulled out from the space. The auxiliary storage compartment 50 is formed to comprise a bottom side 50*a,* two lateral sides 50*b* and a rear side 50*c* which come into direct contact with a bottom side 40*a,* two lateral sides 40*b* and a rear side 40*c* of the heat transfer tray 40, respectively. Therefore, the auxiliary storage compartment 50 according to the preferred embodiment of the present invention takes an upwardly opened hexahedral shape.

A door 52 of the auxiliary storage compartment 50 defines a front face of the auxiliary storage compartment 50. As shown in FIG. 1, the door 52 is exposed toward the front of the refrigerator when the door of the refrigerator is opened. Within the auxiliary storage compartment 50 is formed an upwardly opened storage section 53 which is defined by the bottom side 50*a,* the two lateral sides 50*b,* the rear side 50*c* and the door 52 of the storage compartment. A top portion of the storage section 53 is shielded by the cell cover 32 when the auxiliary storage compartment 50 is received into the heat transfer tray 40.

A temperature sensor 55 for sensing the temperature in the storage section 53 is installed on an inner surface of the rear side 50*c* of the auxiliary storage compartment 50. The temperature sensor 55 transmits information on the sensed temperature to a microcomputer (not shown) of the refrigerator, which serves as a temperature control means. In the microcomputer, the temperature sensed by the temperature sensor 55 is compared with the temperature which a user has set for the auxiliary storage compartment 50, and driving of the blower fan unit 25 is accordingly controlled.

Next, a structure used for mounting the insulating body 20 into the refrigerating chamber 13 will be explained with reference to FIGS. 3 and 4. Herein, the insulating body 20 is shown in these figures as being opened only at a front face thereof.

The insulating body 20 is formed separately from and mounted into the main body 10 of the refrigerator. To this end, each of the cold air supply port 17 and the cold air discharge port 18, which are formed in the barrier 15, is formed to protrude toward the refrigerating chamber 13. Further, fixing rings 60 are installed to wrap around the protruding portions of the cold air supply port 17 and cold air discharge port 18, respectively. Each of the fixing rings 60 is made of elastic material such as rubber and takes a hollow conical shape. The fixing rings 60 are constructed to wrap around the protruding portions of the ports 17, 18 up to tip ends thereof.

Figure 5:
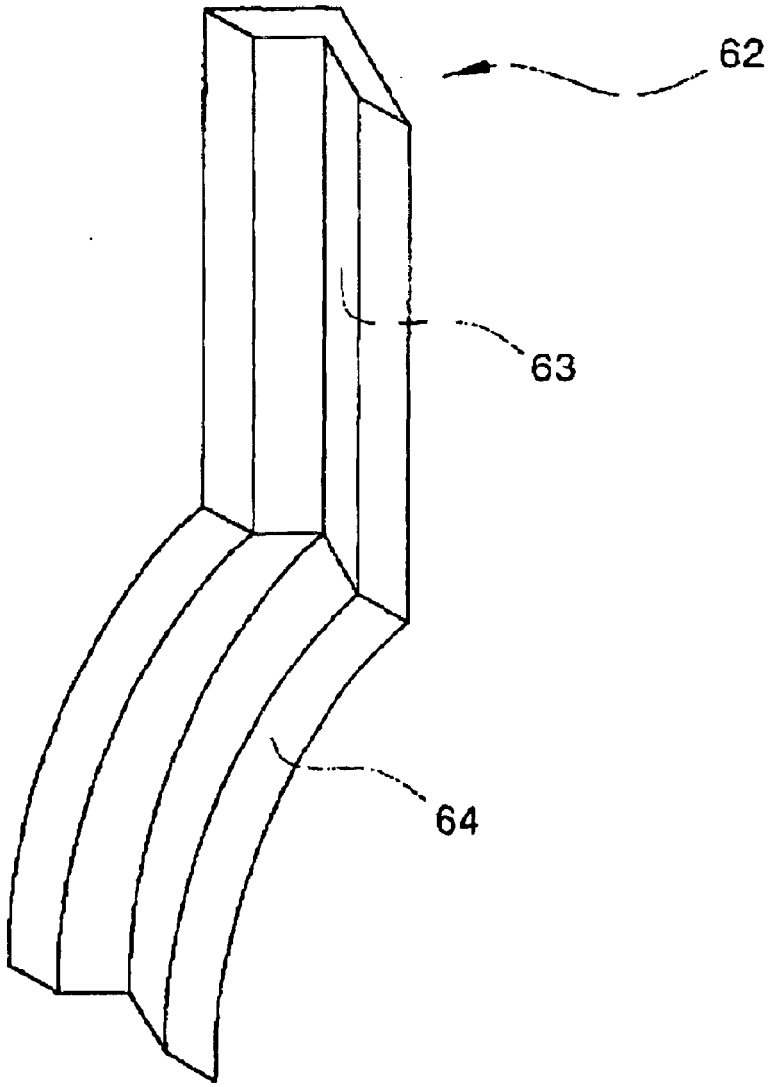
FIG. 5 is a perspective view showing the constitution of an elastic support for supporting a rear edge of the insulating body according to the embodiment of the present invention.

In addition, an elastic support 62 shown in FIG. 5 is installed at a predetermined corner of the refrigerating chamber 13 in which the insulating body 20 is received. The elastic support 62 is installed at the corner of the refrigerating chamber 13 which is located on the side opposite to the ports 17, 18. The elastic support 62 is also made of elastic material such as rubber. The elastic support 62 is used to fill a gap defined between the outer surface of the insulating body 20 and the inner surface of the refrigerating chamber 13, and has such a thickness that the insulating body 20 can be in close contact with the refrigerating chamber 13. A Seating groove 63 in which the corner of the insulating body 20 is securely seated extends vertically along the elastic support 62.

The elastic support 62 is mounted on the corner of the refrigerating chamber 13. For example, in FIG. 5, it is installed at a lowermost end of the refrigerating chamber 13. That is, since a machine room is disposed at the lowermost rear portion of the refrigerating chamber 13, the rear portion of the refrigerating chamber corresponding to the machine room protrudes toward the front of the refrigerator. The elastic support 62 includes a curved portion 64 corresponding to the protruded portion of the refrigerating chamber 13.

Furthermore, in order to bring the insulating body 20 into close contact with the fixing rings 60, each of the cold air inlet and outlet 20*i*, 20*e* through which the cold air can flow into and from the insulating body 20, respectively, includes a contact surface 21 having a shape corresponding to a tip end of the fixing ring 60. The contact surface 21 is an inclined surface which is shaped to correspond to the shape of the tip end of the fixing ring 60, and it is formed around an entrance of the cold air inlet 20*i* and an exit of the cold air outlet 20*e*.

Hereinafter, an operation of the auxiliary storage system for the refrigerator according to the present invention constructed as such will be explained.

Figure 7:
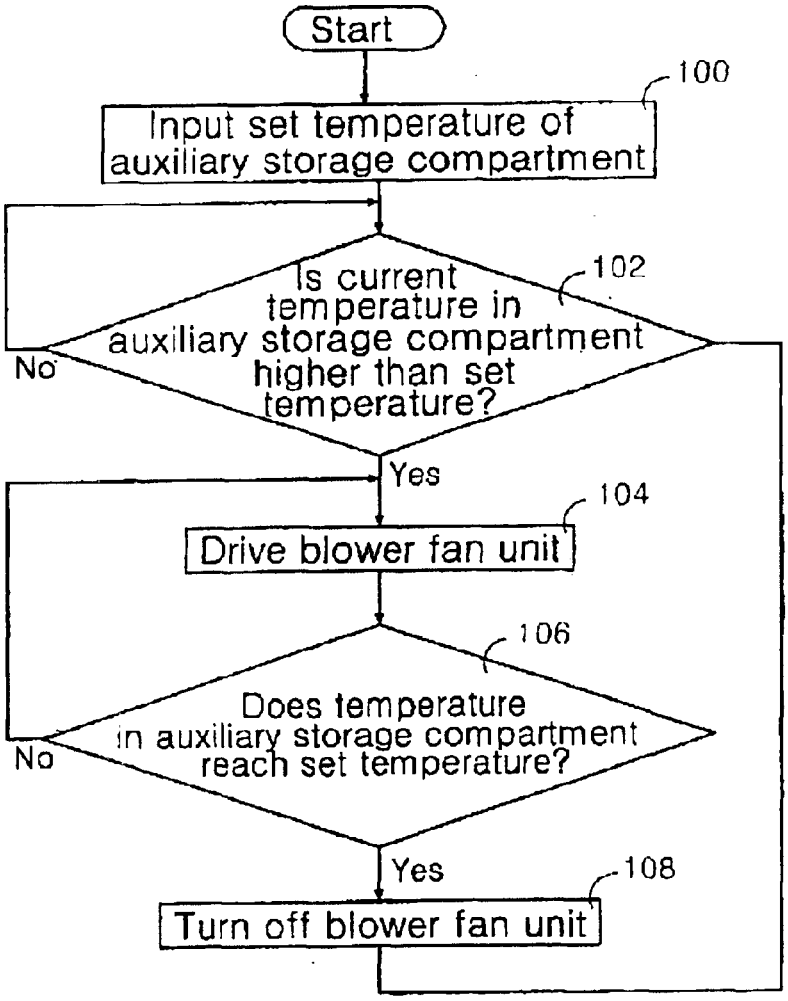
FIG. 7 is a flowchart illustrating the operating process of the embodiment of the present invention.

A process of utilizing the auxiliary storage compartment 50 according to the preferred embodiment of the present invention will be explained with reference to FIG. 7. First, the user presses down a 'set temperature' button installed onto an operating panel (not shown) and inputs a desired temperature value. For example, in case of vegetable, the desired temperature value is set as 0° C.; while in case of meat such as beef, the desired temperature value is set as −7° C. (step 100). The inputted temperature value is transmitted to the microcomputer, and the information on the temperature sensed by the temperature sensor 55 is also transmitted to the microcomputer.

The microcomputer compares the temperature in the auxiliary storage compartment 50 with the desired temperature set by the user (step 102). Then, if the temperature in the auxiliary storage compartment 50 is higher than the set temperature, the microcomputer causes the blower fan unit 25 to be driven (step 104). On the contrary, if the temperature in the auxiliary storage compartment 50 is lower than the set temperature, the process of receiving the temperature information from the temperature sensor 55 and comparing the two temperatures with each other will be continuously repeated.

When the blower fan unit 25 is driven, the cold air in the freezing chamber 12 is introduced into the insulating body 20 of the refrigerating chamber 13 through the cold air supply port 17. Then, the cold air is transferred into the cold air flow passage 42 defined between the heat transfer tray 40 and the insulating body 20 by means of the blower fan unit 25.

Accordingly, heat exchange with the cold air occurs on the outer surface of the heat transfer tray 40, and the temperature of the auxiliary storage compartment 50 installed within the heat transfer tray 40 starts to decrease gradually. That is, heat in the auxiliary storage compartment 50 is transferred to the cold air in the cold air flow passage 42 via the heat transfer tray 40. The cold air which has flowed through the cold air flow passage 42 is returned to the freezing chamber 12 through the cold air discharge port 18.

In the meantime, the information on the temperature sensed by the temperature sensor 55 is continuously transmitted to the microcomputer in which the set temperature is in turn compared with the temperature in the auxiliary storage compartment 50 (step 106). Then, if the temperature in the auxiliary storage compartment 50 reaches the set temperature, the blower fan unit 25 is turned off (step 108). If it is determined from the comparison result in step 106 that the temperature in the auxiliary storage compartment 50 has not yet reached the set temperature, the blower fan unit is continuously driven (step 104).

Furthermore, even though the driving of the blower fan unit 25 is stopped, the temperature sensor 55 continues to sense the temperature in the auxiliary storage compartment 50. The information on the temperature sensed by the temperature sensor is transmitted to the microcomputer and the sensed temperature is then compared with the set temperature so that it can be determined whether the blower fan unit 25 is driven or not.

Figure 6:
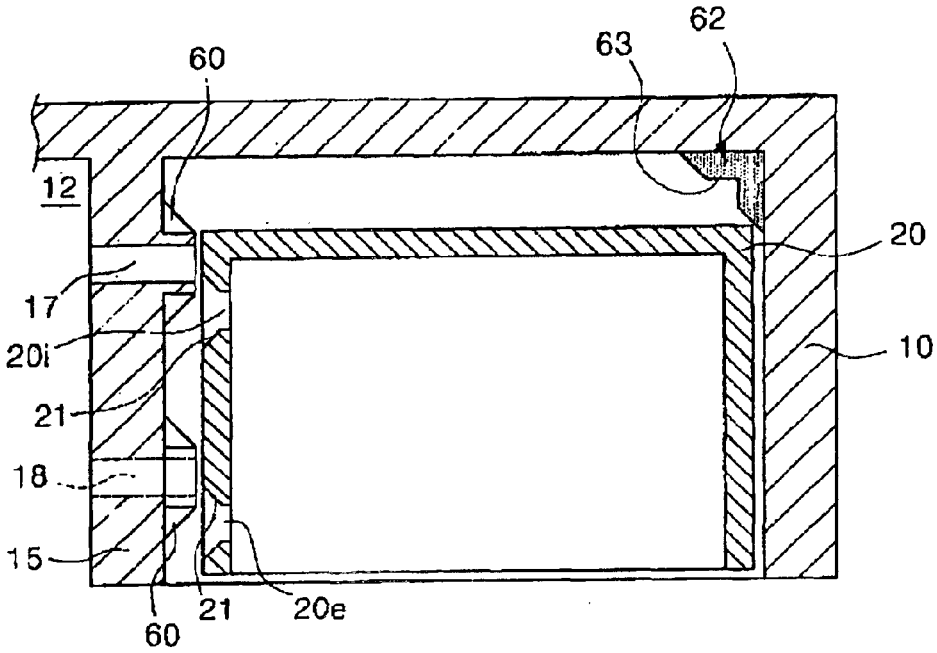
FIG. 6 is a view illustrating working processes of mounting the insulating body into the refrigerating chamber according to the embodiment of the present invention.

Next, a process of mounting the insulating body 20 into the refrigerating chamber 13 will be explained with reference to FIG. 6. Here, the blower fan unit 25, the heat transfer tray 40 and the like have been already installed within the insulating body 20. Further, the fixing rings 60 and the elastic support 62 have also been already installed within the refrigerating chamber 13.

Under these conditions, the insulating body 20 is pushed into the refrigerating chamber 13. Since a width of the insulating body 20 is smaller than an inside width of the refrigerating chamber 13, the insulating body 20 is inserted into the refrigerating chamber 13 in a state where the insulating body comes into close contact with the inner surface of the refrigerating chamber opposite to the surface on which the fixing rings 60 are installed. Therefore, the fixing rings 60 do not interfere with the surface of the insulating body 20 corresponding thereto.

The insulating body 20 is inserted into the refrigerating chamber 13 in a state where a rear end of the insulating body 20 comes into close contact with the elastic support 62. Simultaneously, the insulating body 20 is pushed toward the barrier 15 so that the fixing rings 60 can be snugly inserted into the cold air inlet 20*i* and the cold air outlet 20*e*.

Thus, the corner of the insulating body 20 is introduced into the seating groove 63 while elastically deforming one side of the elastic support 62. Then, the fixing rings 60 are inserted and seated into the cold air inlet 20*i* and the cold air outlet 20*e* while they are guided along the inclined contact surfaces 21 of the cold air inlet 20*i* and the cold air outlet 20*e,* respectively.

Figure 3:
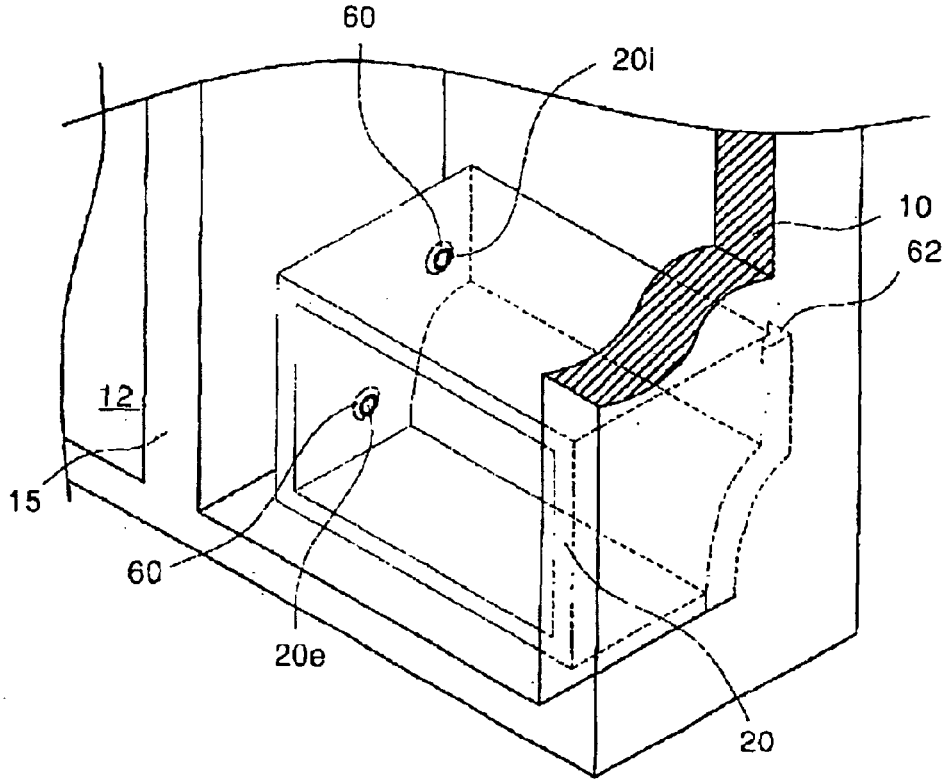
FIG. 3 is a schematic perspective view showing the constitution for installing an insulating body into a refrigerating chamber according to the preferred embodiment of the present invention.
Figure 4:
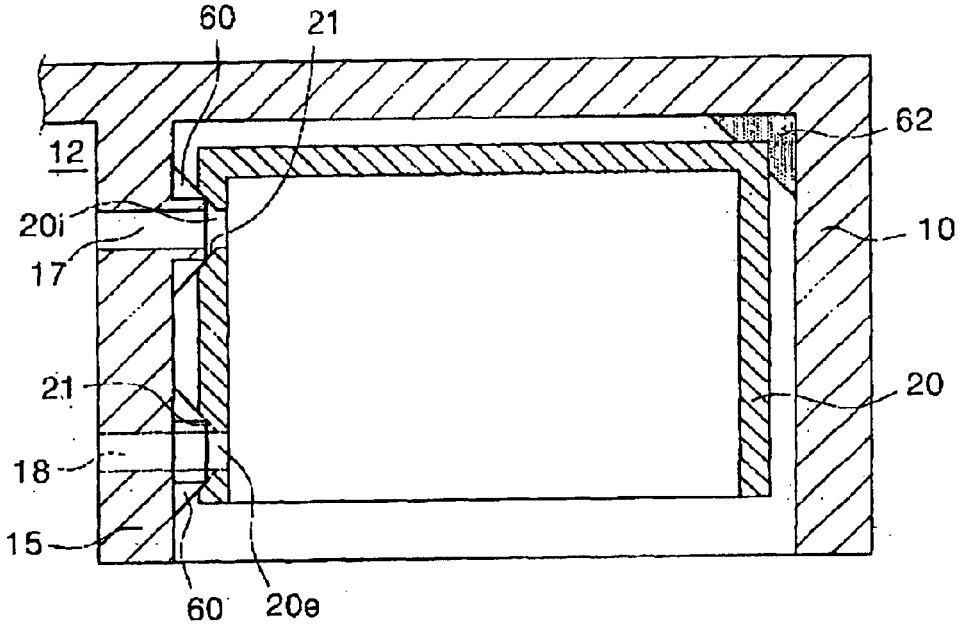
FIG. 4 is a section view taken along line A–A' of FIG. 3.

FIGS. 3 and 4 show the assembled state of the insulating body into the refrigerating chamber. At this time, the insulating body 20 is prevented from moving or playing within the refrigerating chamber, because each of the fixing rings 60 and the elastic support 62 is pressed by the insulting body 20 and elastically deformed to some extent. Further, the cold air does not leak out between the cold air supply port 17 and the cold air inlet 20*i* and between the cold air discharge port 18 and the cold air outlet 20*e,* because the fixing rings 60 are in close contact with the cold air inlet 20*i* and the cold air outlet 20*e,* respectively.

The auxiliary storage compartment 50 of the present invention is not always installed within the refrigerating chamber 13. Alternatively, the auxiliary storage compartment 50 may be installed within the freezing chamber 12 so that it can be supplied with the cold air in the freezing chamber 12 so as to keep it at a predetermined temperature.

As described specifically in the foregoing, the auxiliary storage system for use in the refrigerator according to the present invention is constructed such that the auxiliary storage compartment installed within the refrigerating chamber is isolated from the refrigerating chamber by means of the insulating body. With such constitution, the interior of the auxiliary storage compartment is less influenced by the ambient environment, and thus, the set temperature thereof can be maintained more reliably. Thus, the goods stored in the auxiliary storage compartment can be stored longer and fresher.

Further, according to the present invention, the cold air supply port and the cold air discharge port through which the cold air is supplied into and discharged from the insulating body, respectively, are formed at the locations corresponding to the rear and front ends of the insulating body, and thus, the cold air can flow from the rear end to the front end of the insulating body. Therefore, the heat exchange with the cold air is performed throughout the surface of the heat transfer tray installed within the insulating body. Accordingly, there is an advantage in that the temperature in the auxiliary storage compartment can be uniformly maintained as a whole.

Furthermore, since the fixing rings and the elastic support which are made of elastic materials are utilized when installing the insulating body into the refrigerating chamber, the insulating body is firmly secured into the refrigerating chamber. The cold air transferred from the freezing chamber into the insulating body does not leak into the refrigerating chamber. Therefore, there is also an advantage in that the refrigerating chamber is not excessively cooled.

It should be understood that a person skilled in the art to which the invention pertains may make various changes and modifications to the present invention within the scope of the present invention defined by the appended claims.

What is claimed is:

1. An auxiliary storage system for a refrigerator, comprising:

an insulating body which includes a forwardly opened predetermined space therein, is installed within a storage space of the refrigerator, and are formed of insulating material to prevent heat exchange with the storage space;

a blower fan unit for supplying cold air into the insulating body;

a heat transfer tray installed within the space of the insulating body for defining a cold air flow passage between the insulating body and the heat transfer tray and performing heat exchange between an internal space thereof and the cold air flowing through the flow passage;

a drawer type auxiliary storage compartment which can be pushed into and pulled out from the heat transfer tray through a front face of the insulating body;

a shelf for shielding a top side of the insulating body so as to define a space for accommodating the auxiliary storage compartment in cooperation with the insulating body;

a sensing device installed within the auxiliary storage compartment for sensing a temperature therein; and a temperature control device for controlling the temperature in the auxiliary storage compartment by controlling the blower fan unit while comparing information on the temperature sensed by the sensing device with a temperature set by a user.

2. The auxiliary storage system as claimed in claim 1, wherein the insulating body is installed at one side of a refrigerating chamber formed adjacent to a freezing chamber, and the cold air in the freezing chamber is supplied into the insulating body through any one of rear and front sides of the insulating body and is discharged from the insulating chamber through the other side thereof.

3. The auxiliary storage system as claimed in claim 1, wherein a cell cover for maintaining humidity in the auxiliary storage compartment is further provided between a bottom surface of the shelf and a top side of the insulating body.

4. The auxiliary storage system as claimed in claim 1, wherein the blower fan unit is installed at a rear portion within the insulating body.

5. The auxiliary storage system as claimed in claim 1, wherein the heat transfer tray is made of aluminum.

6. The auxiliary storage system as claimed in claim 1, wherein fixing rings, which are made of elastic materials and installed around protruding portions of a cold air supply port and a cold air discharge port of a barrier toward the insulating body, are seated into a cold air inlet and a cold air outlet of the insulating body, respectively, and a corner of the insulating body opposite to the cold air inlet and outlet is supported by an elastic support which is seated onto a corner of the storage space, whereby the insulating body is fixed into the storage space.

7. The auxiliary storage system as claimed in claim 6, wherein the fixing rings take a hollow conical shape and each of the cold air inlet and outlet has a shape corresponding to that of the fixing ring.

* * * * *